US006405468B1

(12) United States Patent
Gilgenbach

(10) Patent No.: US 6,405,468 B1
(45) Date of Patent: Jun. 18, 2002

(54) FIREARM LOCKING APPARATUS WITH DETACHABLE GRIP KEY

(76) Inventor: James E. Gilgenbach, 9375 Lochard Rd., Sidney, OH (US) 45365

( * ) Notice: Subject to any disclaimer, the term of this patent is extended or adjusted under 35 U.S.C. 154(b) by 0 days.

(21) Appl. No.: 09/533,901

(22) Filed: Mar. 20, 2000

(51) Int. Cl.[7] ..... F41A 17/00
(52) U.S. Cl. ..... 42/70.06; 42/70.01
(58) Field of Search ..... 42/70.01, 70.06, 42/70.07, 70.11

(56) References Cited

U.S. PATENT DOCUMENTS

| | | | | | |
|---|---|---|---|---|---|
| 678,420 | A | | 7/1901 | Neuber et al. | |
| 834,772 | A | | 10/1906 | Tambour | |
| 2,335,669 | A | | 11/1943 | Hanson | 42/70 |
| 2,525,886 | A | | 10/1950 | Frasier | 42/70 |
| 2,775,051 | A | | 12/1956 | Gehman | 42/70 |
| 2,967,367 | A | | 1/1961 | Ivy | 42/69 |
| 2,978,826 | A | | 4/1961 | Ivy | 42/70 |
| 3,605,312 | A | | 9/1971 | Domain | 42/70 E |
| 4,689,912 | A | | 9/1987 | Gillum | 42/105 |
| 5,025,582 | A | * | 6/1991 | Mote, Sr. | 42/70.06 |
| 5,123,193 | A | * | 6/1992 | Pugh | 42/70.11 |
| 5,433,028 | A | * | 7/1995 | Novak et al. | 42/70.06 |
| 5,651,206 | A | * | 7/1997 | Matarazzo | 42/70.08 |
| 5,678,342 | A | * | 10/1997 | Felk | 42/69.02 |

* cited by examiner

*Primary Examiner*—Charles T. Jordan
*Assistant Examiner*—Kimberly S. Smith
(74) *Attorney, Agent, or Firm*—Donald Cayen

(57) ABSTRACT

Apparatus is provided to prevent unauthorized use of a firearm, by locking the trigger in place unless a removable component is available to place the firearm in operative mode. The apparatus includes a locking mechanism comprising a plurality of locking elements, each movable between trigger locking and trigger release positions, and a key guide body provided with a plurality of apertures, each corresponding to one of the locking elements. A grip key adapted for engagement by the hand of a user of the firearm enables the user to readily seat the grip key in a specified position against the firearm, and to detach the grip key therefrom, selectively. A plurality of key elements are mounted upon the grip key, each disposed for insertion through one of the apertures to urge a corresponding locking element to its trigger release position, when the grip key is seated in the specified position.

18 Claims, 11 Drawing Sheets

FIREARM LOCKING APPARATUS WITH DETACHABLE GRIP KEY

BACKGROUND OF THE INVENTION

The invention disclosed and claimed herein generally pertains to a locking apparatus for guns, firearms and the like, which enables a user thereof to fire or discharge a gun only if a detachable key device is available to operate the locking apparatus. More particularly, the invention pertains to apparatus of the above type wherein the key device may be readily inserted into and removed from the locking apparatus by the gun user, as desired. Even more particularly, the invention pertains to apparatus of the above type wherein a particular key device will be able to operate a locking apparatus mounted on a particular gun, but will be unable to operate a similar locking apparatus mounted on a different gun.

A large number of designs for gun safety devices and trigger safety mechanisms are available in the prior art, to prevent firearms from being inadvertently discharged. While these designs have improved gun safety, they are generally directed to arrangements wherein all parts of the gun safety mechanism remain attached to the gun. Thus, such arrangements are not able to prevent the gun from being fired by an unauthorized user. For example, if a gun came into the possession of an unattended young child, the child could inadvertently release the safety mechanism, while exploring the gun or playing with it. Accordingly, a very dangerous situation could be created, even though the gun was equipped with a safety device of the prior art.

In another example, an unauthorized user might have to break into a locked cabinet or closet in order to gain access to a gun provided with a conventional safety device. However, after obtaining the gun, the unauthorized user would be able to fire it, merely by releasing the safety device in accordance with its normal mode of operation. The conventional safety device would in no way impede such undesired, and possibly illegal and dangerous use of the gun. As a further example, peace officers, who need to carry guns in the course of their duties, face a continuing threat from violent individuals who may attempt to seize or wrest their guns from them. A conventional safety device, which is generally intended for the convenient use of any person who happens to be in possession of a gun, would fail to prevent the seized gun from being used against the officer or others.

More recently, trigger locking mechanisms have been developed which require use of a magnet or electrical component to release the trigger. However, these types of devices tend to lack the reliability and simplicity required by many firearm users, particularly police and other security officers.

SUMMARY OF THE INVENTION

In making the invention, it was recognized that serious disadvantages in prior art gun safety devices, and particularly those referred to above, in connection with unauthorized use, could be overcome by providing a gun locking apparatus which included an essential component which was readily detachable from the gun. In the absence of the essential component, the gun would be made inoperable and could not be fired. Accordingly, gun safety could be significantly enhanced, and unauthorized use substantially prevented, simply by securely storing the critical component or by keeping it at a location remote from the gun.

Generally, the invention is directed to apparatus for use with a gun or firearm which is provided with a handle, and also with a trigger disposed for specified movement to discharge the firearm. The apparatus comprises a locking mechanism mounted on the firearm which is selectively moveable between trigger locking and trigger release positions or modes. The locking mechanism acts to prevent trigger movement when in the trigger locking position, and enables trigger movement when in the release position. The apparatus further comprises means for biasing the locking mechanism into its trigger locking position, and a key support member adapted for engagement by the hand of a user of the firearm. The key support member enables the user to seat the key support member against the firearm handle, in a specified position relative thereto, or to detach the key support member from the firearm, selectively. A specified number of key elements are mounted on the key support member, each of the key elements operating to urge the locking mechanism to its trigger release position when the key support member is seated against the handle in the specified position.

In a preferred embodiment, a plurality of key elements are mounted on the key support member, and the apparatus includes a key guide body provided with an aperture corresponding to each of the key elements. Each of the apertures has dimensions which substantially match the dimensions of a cross-section of its corresponding key element, and the key guide body is joined to the firearm to enable each of the key elements to pass through its corresponding aperture as the key support member is being seated against the handle in the specified position. By providing such arrangement of key elements and apertures, the key element of a particular key support member may be readily designed to uniquely mate with only one particular key guide body. Preferably, the key support member is provided with alignment means for guiding the key support member to the specified position relative to the handle. Preferably also, the key support member is provided with a selected number of rings, each of the rings disposed to receive a finger of the user's hand. The user is thereby enabled to swiftly and easily bring the key elements into union with the key guide body, while maintaining a very firm grip upon the key support member.

It is anticipated that in one very useful embodiment, the invention may be readily adapted for use with a firearm having a sliding trigger, that is, a trigger which is translated along a trigger guard to fire or discharge the firearm. In another useful embodiment, the invention may be readily adapted for use with a trigger which is pivotably moved about a specified point to discharge the firearm.

OBJECTS OF THE INVENTION

An object of the invention is to significantly enhance firearm safety, and to prevent unauthorized use of firearms, by providing a locking apparatus which prevents the gun from being fired unless a removable component is available to place the apparatus in a release mode.

Another object is to provide apparatus of the above type wherein the removable component is comparatively small, and can be easily stored in locations remote from the firearm.

Another object is to provide apparatus of the above type wherein the removable component may be quickly and easily inserted into the locking apparatus, minimizing interference with normal use of the firearm.

Another object is to provide apparatus of the above type wherein the user is enabled to maintain a very firm grip on the removable component while it is being employed to release the locking apparatus to enable operation of the firearm.

Another object is to provide apparatus of the above type wherein the removable component can be put in place without being viewed by the firearm user, such as when the user is in the dark, has the firearm behind his back or to his side, or when he must keep his eyes firmly fixed on a prospective target.

Another object is to provide a large number of locking apparatuses of the above type, each disposed for use with a different firearm, wherein the removable component for a particular locking apparatus could not be used to release any of the others.

These and other objects and advantages of the invention will become more readily apparent from the ensuing specification, taken together with the accompanying drawings.

DETAILED DESCRIPTION OF PREFERRED EMBODIMENT

Figure 1:
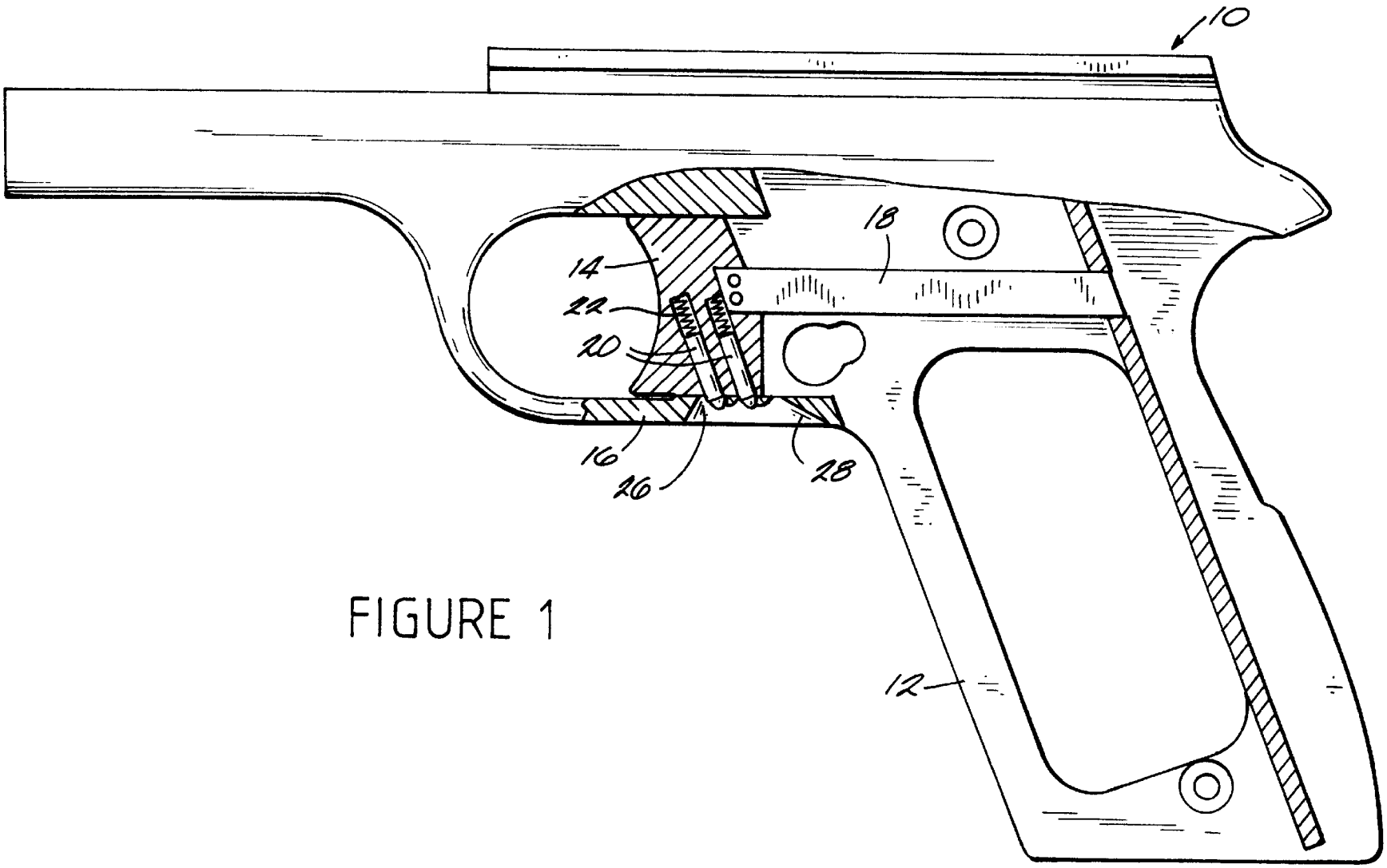
FIG. 1 is a partial sectional view showing a firearm provided with an embodiment of the invention.

Referring to FIG. 1, there is shown a handgun 10, such as a Colt 45 automatic pistol, which has a handle 12 and may be readily adapted for use with an embodiment of the invention. As is well known, handgun 10 has a sliding type of trigger mechanism. More particularly, handgun 10 is provided with a trigger shoe 14 which is constrained to translational motion, that is, to rightward and leftward motion as viewed in FIG. 1, along a trigger guard 16. Thus, to fire handgun 10 a user would pull trigger shoe 14 to the right with his finger (not shown) whereupon sliding member 18, moving with the trigger shoe, would cause the firing pin of gun 10 to strike against a chambered round or bullet. The bullet, firing pin and internal linkages between sliding member 18 and the firing pin are conventional and well known to those of skill in the art and, accordingly, are not shown. After the user fires the gun and relaxes his finger, a spring in gun 10 (not shown) automatically moves the trigger shoe to the left as viewed in FIG. 1, back to a pre-firing position.

Figure 2:
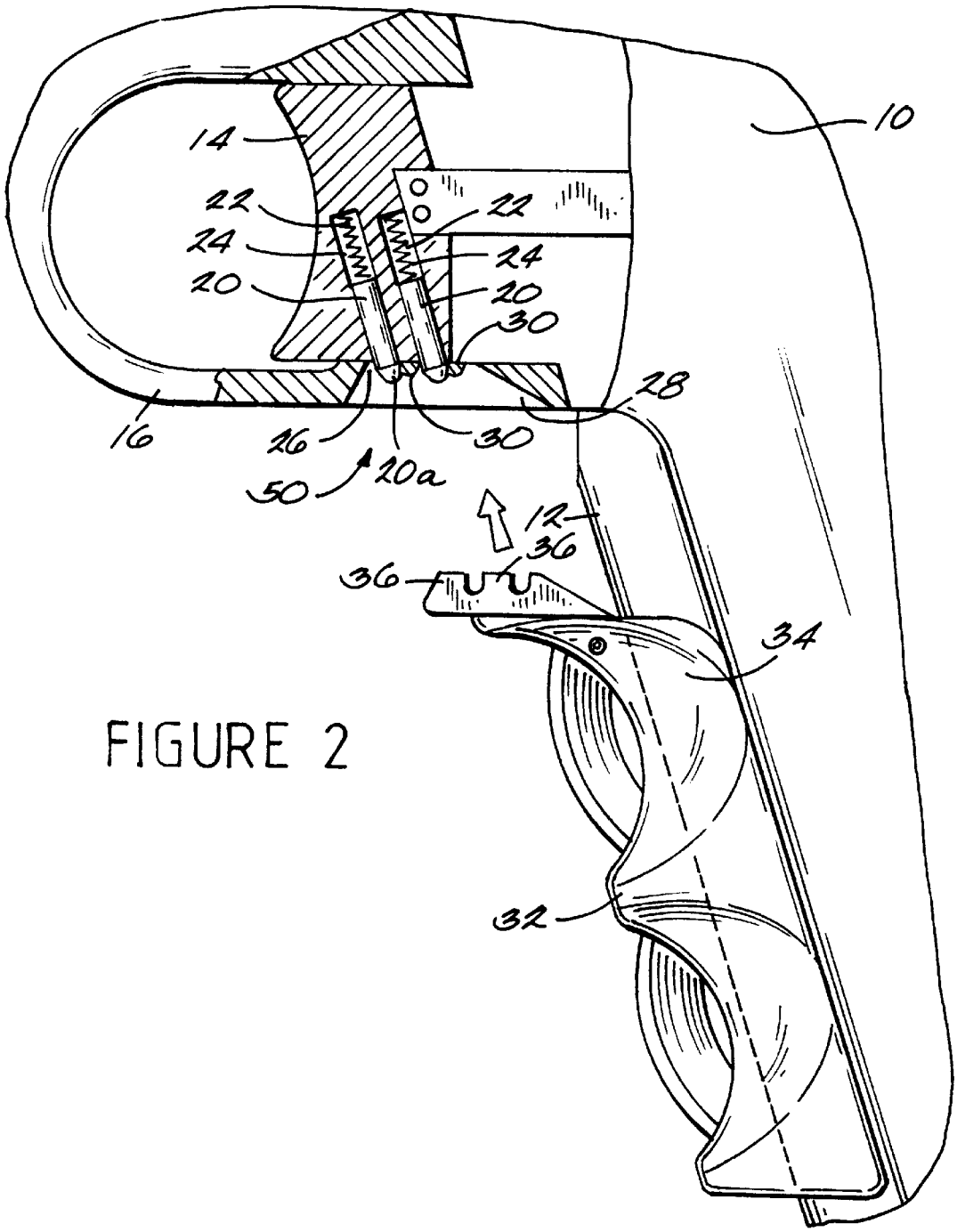
FIG. 2 is a partial sectional view showing the embodiment of FIG. 1 in greater detail.

Referring to FIG. 2, there is shown trigger shoe 14 in the pre-firing position. There is further shown two locking pins 20, each inserted along most of its length into a well or bore 22 formed in trigger shoe 14. However, a beveled front end 20*a* of each pin 20 is urged downwardly as viewed in FIG. 2, by the action of a spring 24 contained in its corresponding bore 22, into a complementary aperture 26. Each aperture 26 is formed in trigger guard 16 and is in communication with a slot 28, also formed therein. It will be seen that when the ends 20*a* of pins 20 are inserted into the apertures 26, trigger shoe 14 is locked in its pre-firing position, so that gun 10 cannot be fired.

For reasons described hereinafter, FIG. 2 further shows the bores 22 formed in trigger shoe 14 so that their respective axes are at an angle such as on the order of 70°–75° to the trigger guard, rather than perpendicular thereto. Thus, pins 20 are directed downwardly at such angle, rather than vertically downward.

Figure 4:
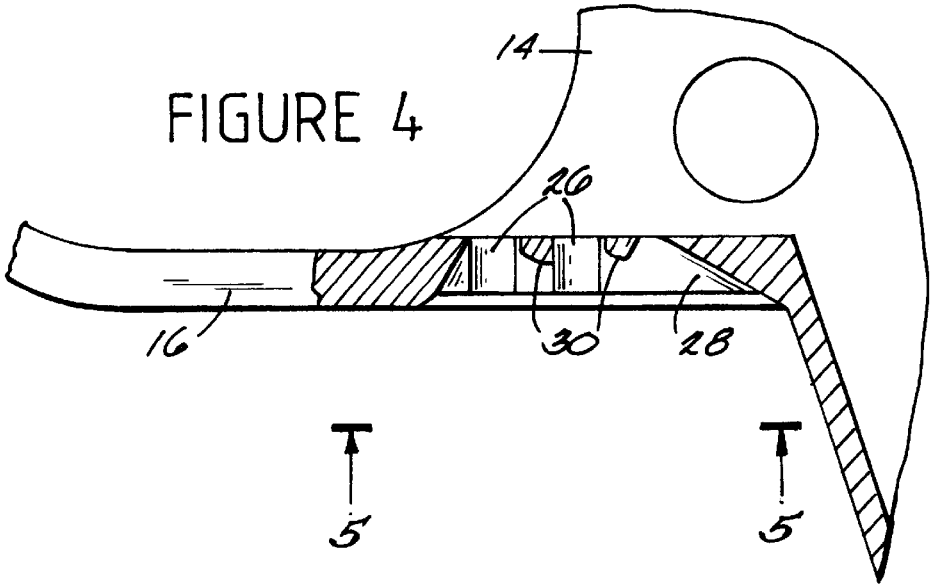
FIG. 4 is a partial sectional view showing a portion of FIG. 2 in greater detail, with the locking pins removed therefrom.
Figure 5:
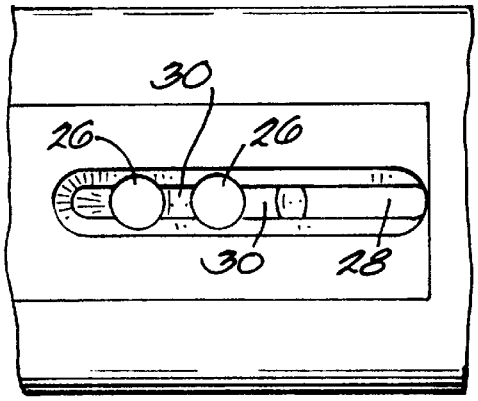
FIG. 5 is a view taken along lines 5—5 of FIG. 4.
Figure 3:
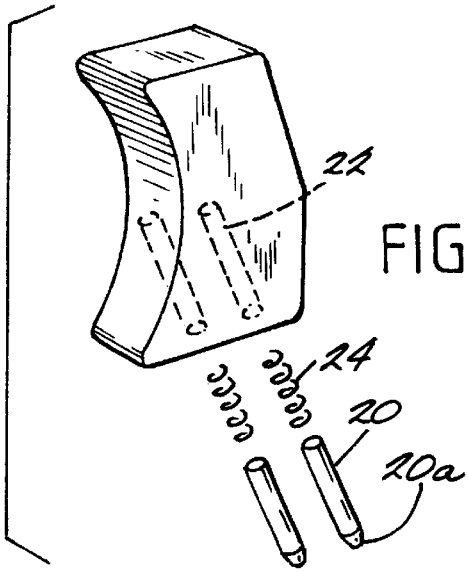
FIG. 3 is an exploded perspective view showing certain components of the embodiment of FIG. 1.

Referring to FIG. 3, there is shown pins 20 and springs 24 in exploded perspective with respect to trigger shoe 14. Referring to FIGS. 4 and 5 together, there are shown the apertures 26 with the pins 20 removed therefrom, and the slot 28, which is usefully formed in trigger guard 16 by means of a milling operation. Referring further to FIGS. 4 and 5, it is seen that the milling operation forms two downwardly projecting regions or lands 30 in slot 28, just to the right of each of the apertures 26.

As best shown by FIG. 2, because bores 22 are oriented so that locking pins 20 are urged downward in the angled direction referred to above, rather than in a vertical direction, the pins 20 are unable to move downward past their respective lands 30. Thus, the lands provide a very simple means for retaining locking pins 20 in the bores 22, after the pins have moved into their respective apertures 26 to lock the trigger shoe 14 in place. In another embodiment, pins 20 could be oriented to move straight down, i.e., in a vertical direction. However, it would then be necessary to form shoulders in the pins and reduced diameters for the apertures 26, to prevent downward loss of the pins 20.

Figure 6:
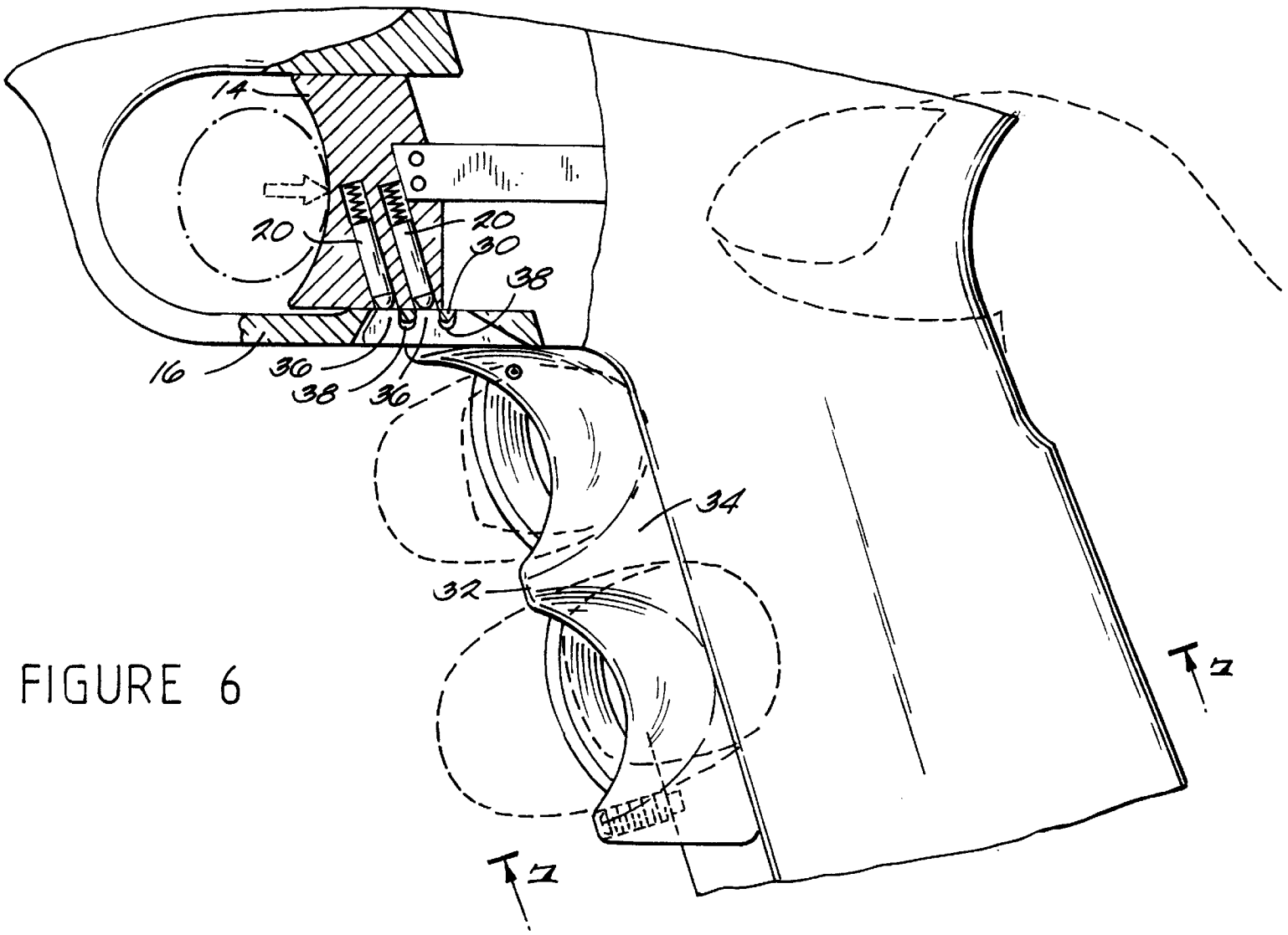
FIG. 6 is a partial sectional view showing the embodiment of FIG. 1 in a released position.

Referring further to FIG. 2, there is shown a grip key 32, comprising an essential element of the embodiment of the invention, being moved along handle 12 of gun 10, toward slot 28 and locking pins 20. Grip key 32 comprises a key support member 34 and key elements 36 mounted thereon, one key element corresponding to each locking pin 20. Key support member 34 is designed to readily engage the left edge of gun handle 12, in complementary relationship, and to easily move therealong. Key support member 34 is further designed to be firmly grasped or gripped by the same hand that a user of gun 10 intends to employ in holding and operating the gun, as shown in FIG. 6. It is anticipated that by a very easy and natural movement thereof, the grip key 32 can readily be put in place and held therein, to enable operation of gun 10.

Key elements 36 are sized for unimpeded insertion into slot 28, as grip key 32 is moved upward, as viewed in FIG. 2. Thereupon, as shown by FIG. 6, each of the key elements engages one of the locking pins 20, and urges it upwardly, out of its aperture 26. Trigger shoe 14 is thereby released, so that gun 10 may be fired. FIG. 6 further shows notches 38 provided between key elements 36, the notches being sized to accommodate respective lands 30, in order to avoid interference therewith as the key elements move into the slot 28.

Figure 7:
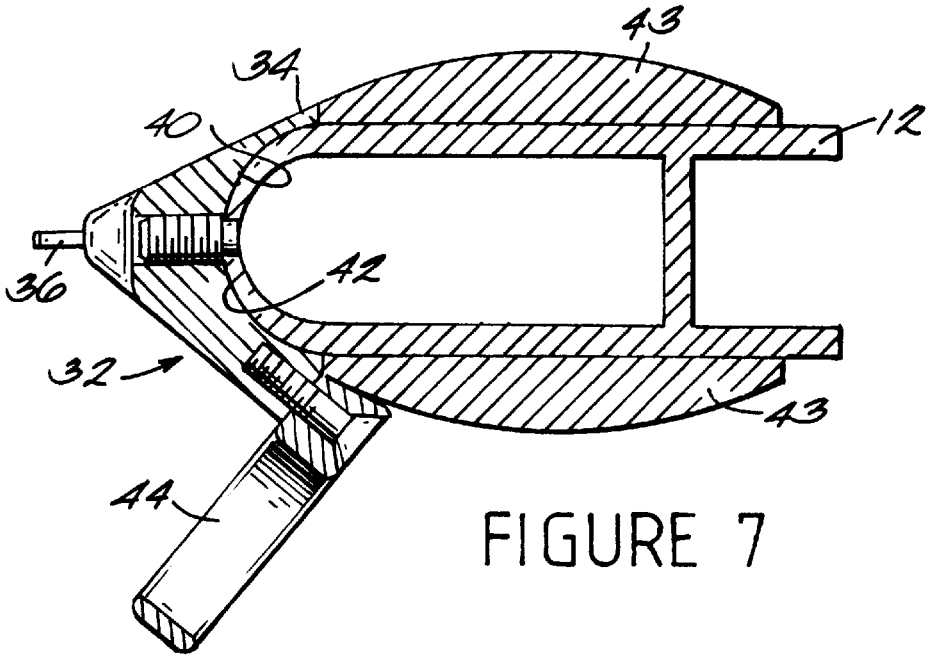
FIG. 7 is a sectional view taken along lines 7—7 of FIG. 2.
Figure 8:
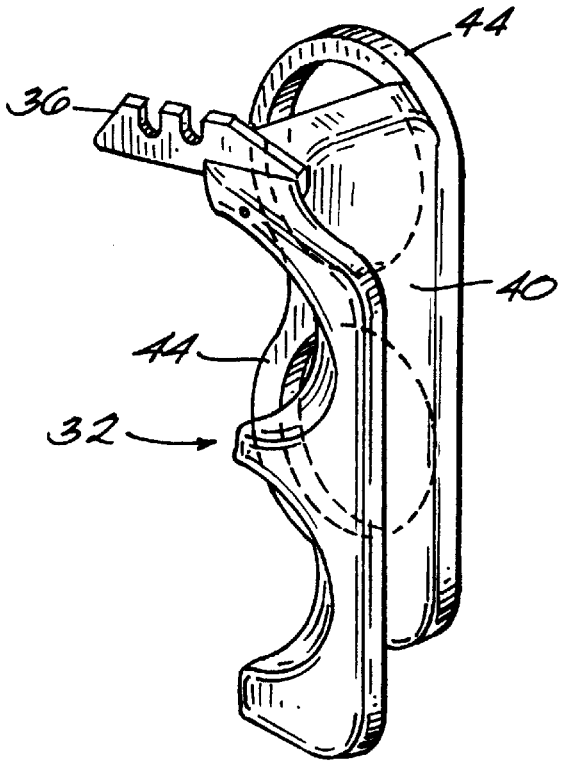
FIG. 8 is a perspective view showing a grip key for the embodiment of FIG. 1.

Referring to FIGS. 7 and 8 together, there is shown grip key 32 provided with a concave surface 40, which is disposed to mate in complementary relationship with a convex surface 42 extending along the edge of handle 12 which is oriented toward trigger guard 16. FIG. 7 further shows gun handle 12 provided with grips 43, with key support member 34 being guided along the edges thereof. FIG. 8 further shows two finger rings 44 joined to grip key 32, which are disposed to receive the second and third fingers of a user's hand, as shown in FIG. 6. The provision of finger rings 44 substantially enhances security in the use of the gun 10, for example, by a police officer. If the gun was to be suddenly grabbed out of the user's hand, the user would retain possession of the grip key 32, so that the gun could not be used against him.

Referring further to FIG. 2, there is shown the lands 30, together with the structure forming slot 28 and apertures 26 in trigger guard 16, referred to collectively as key guide body 50. As stated above, the key guide body 50 may be formed by selective milling and drilling operations in a portion of the trigger guard adjacent to the pre-firing position of trigger shoe 14. Alternatively, key guide body 50 may comprise an insert disposed for placement into a correspondingly dimensioned hole or aperture formed in the trigger guard.

Figure 9:
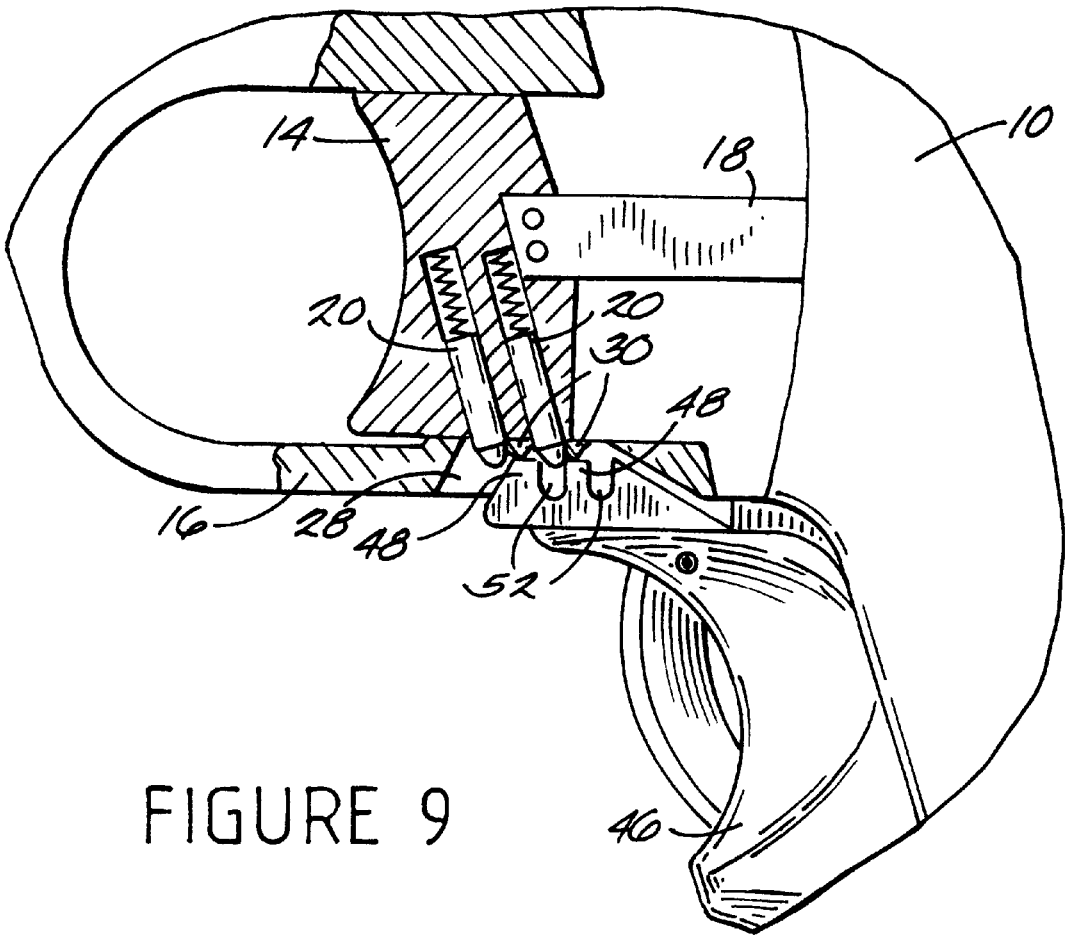
FIG. 9 is a partial sectional view showing the inoperability of a non-matching grip key in the embodiment of FIG. 1.

Usefully, as an additional security measure, grip key 32 and key guide body 50 may be uniquely designed so that they will generally match and be operable with each other. This is illustrated by FIG. 9, which shows a grip key 46, rather than the grip key 32, being employed in an effort to release locking pins 20. Grip key 46 is designed to work with a trigger locking mechanism which is not shown, but which operates in the manner described above and includes locking pins 20 and a key guide body similar to key guide body 50. However, such key guide body has certain dimensions which are slightly different from corresponding dimensions of key guide body 50. Accordingly, dimensions of the grip key 46, and in particular the dimensions of key elements 48 and notches 52 thereof, are likewise different from corresponding dimensions of grip key 32. Thus, when the key elements 48 are inserted into slot 28, they encounter lands 30 and are unable to lift the pins 20 out of their respective apertures 26. Trigger shoe 14, accordingly, remains locked in place. It is anticipated that those of skill in the art will be able to readily provide a large number of trigger locking devices of the type described above wherein, by slight changes of dimensions, each grip key will be useable with only one particular key guide body. Accordingly, if the owner of a gun equipped with one of the locking devices keeps the grip key required therefor at a location remote from the gun, an unauthorized person gaining access to the gun will be unable to fire it. It is noted that by providing at least two locking pins 20, it would be very difficult to release them both simultaneously, by using a pair of narrow pins, stiff wire or the like. In other embodiments of the invention, three or more locking pins could be used to further complicate the task of releasing the trigger in the absence of the grip key specifically designed therefor.

Figure 10:
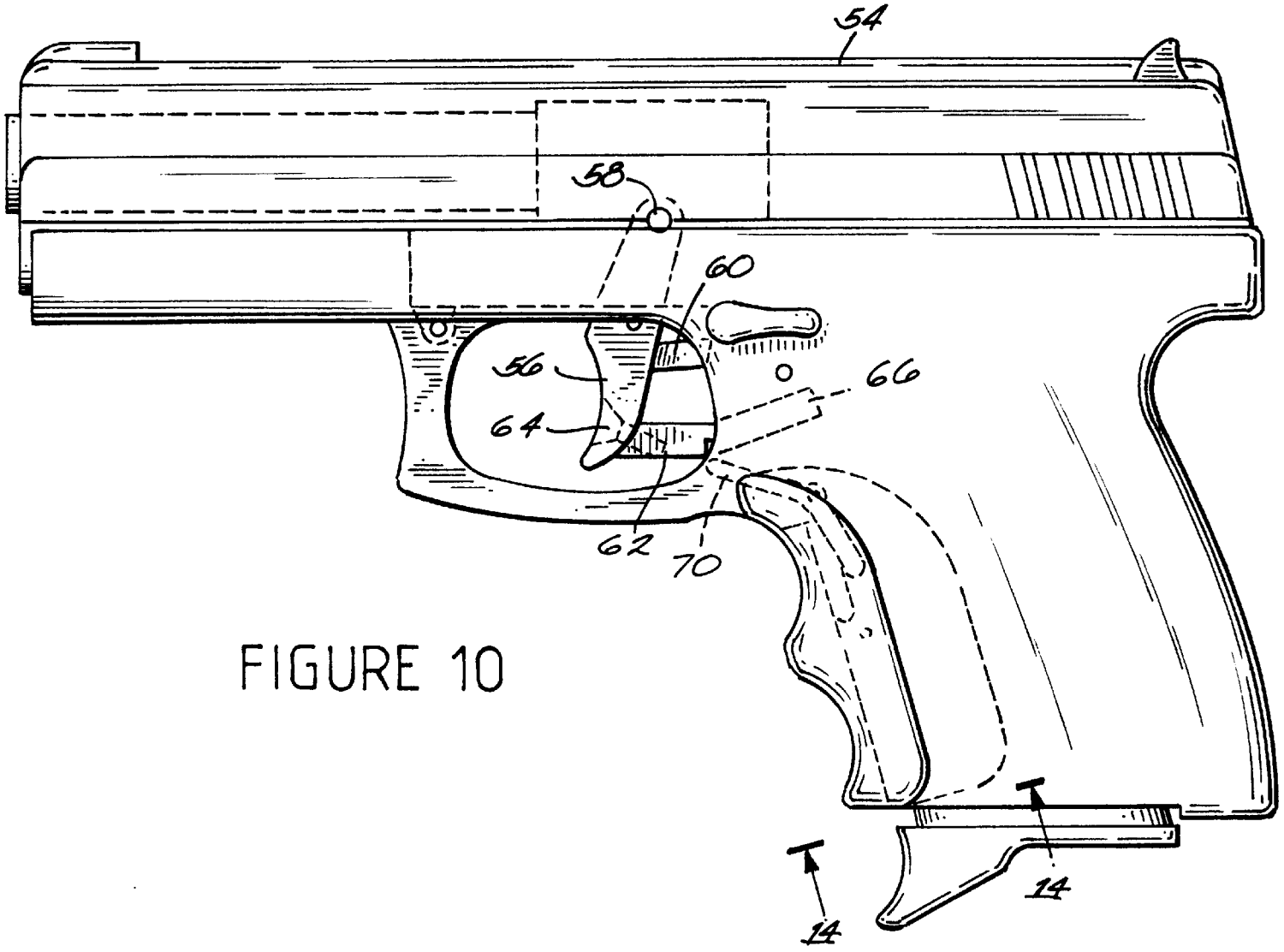
FIG. 10 is a partial sectional view showing a firearm provided with a second embodiment of the invention.

Referring to FIG. 10, there is shown a gun 54 having a trigger 56 which is pivoted in a counterclockwise direction about a pin 58, as viewed in FIG. 10, to fire the gun. Such movement causes a sliding member 60 to move rightward with the trigger 56, whereupon the firing pin of gun 54, driven by internal linkages connected between the member 60 and the firing pin, strikes a chambered bullet to fire the gun. As with gun 10, the bullet, internal linkages and firing pin are not shown.

Figure 11:
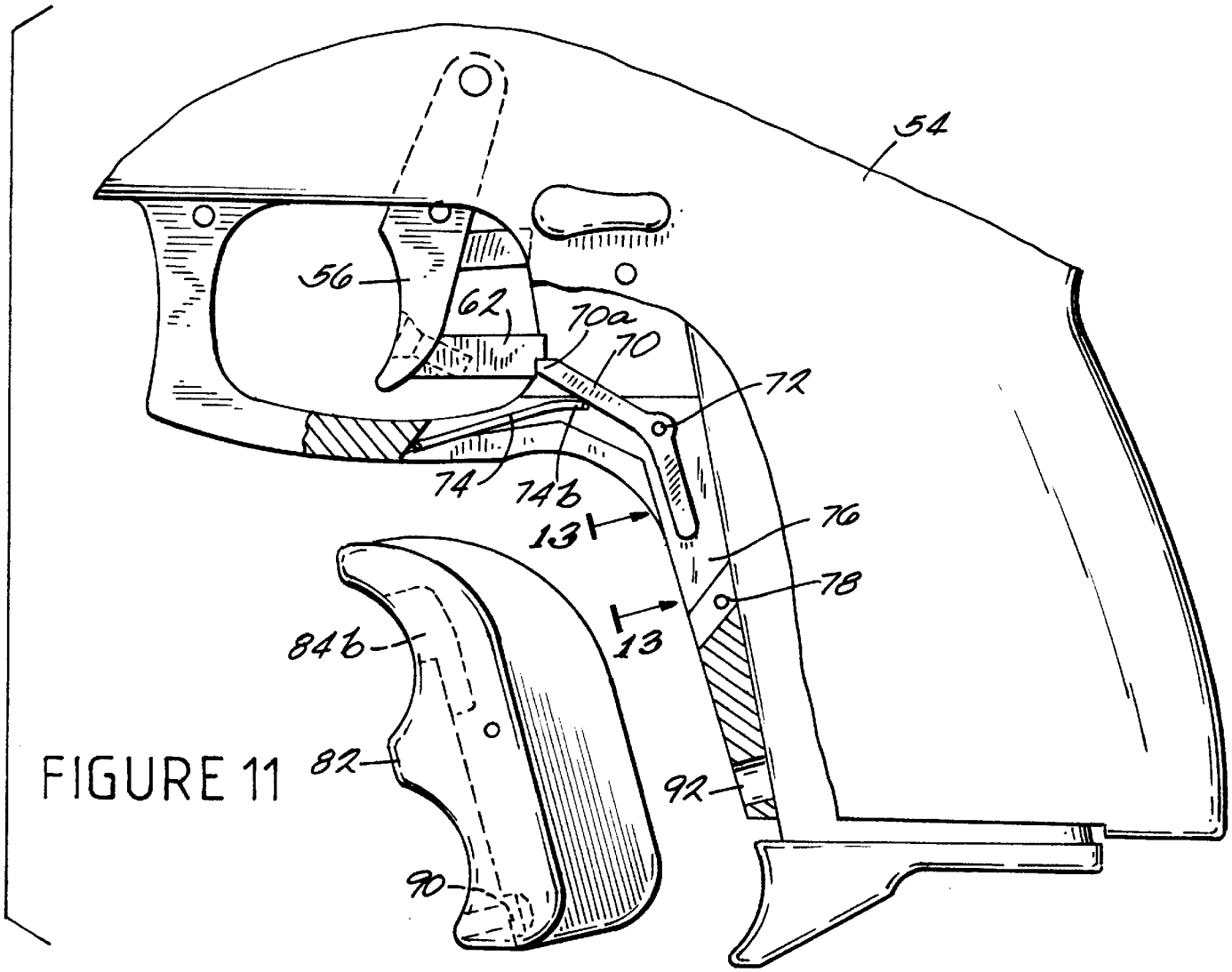
FIG. 11 is a partial sectional view showing the embodiment of FIG. 10 in greater detail.
Figure 12:
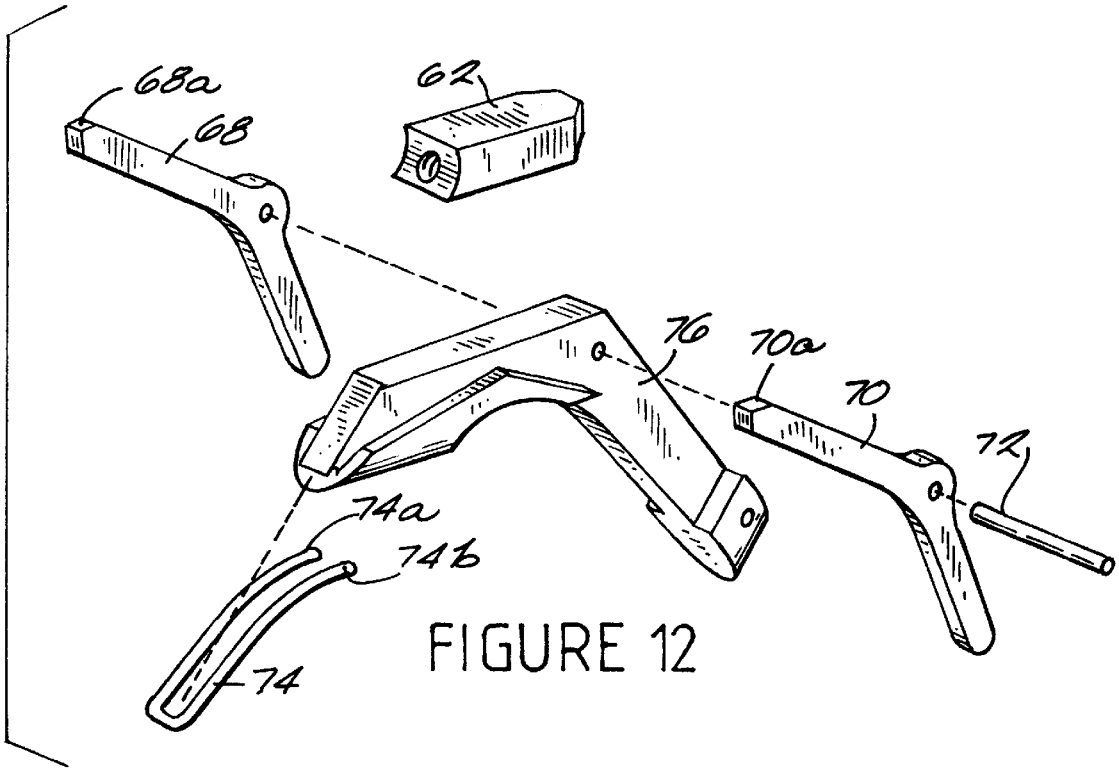
FIG. 12 is an exploded perspective view showing certain components of the embodiment shown in FIG. 10.

In order to adapt an embodiment of the invention to a gun having a pivoting trigger, rather than the sliding trigger described above, a lug 62 is joined behind the trigger 56 by means of a screw 64 or the like. The lug 62 is disposed to enter a recess 66 provided in the handle of gun 54 when trigger 56 is pulled to move rightward to fire the gun. However, to prevent inadvertent discharge a pair of safety levers 68 and 70 are positioned, as best shown in FIG. 11, to selectively prevent movement of the lug 62 and trigger 56. More particularly, levers 68 and 70 are pivotably mounted, in side-by-side relationship along a pin 72. (Lever 68 is hidden in FIG. 11 by the lever 70). A spring 74 is also provided, which has two end elements 74*a* and 74*b*. End elements 74*a* and 74*b* act against the levers 68 and 70, respectively, to urge respective ends 68*a* and 70*a* thereof upwardly, to block movement of lug 62. Thus, lug 62, levers 68 and 70 and spring 74 cooperatively interact to prevent operation of trigger 56. Referring further to FIG. 12, there is shown safety levers 68 and 70 and spring 74 mounted on a key guide body 76 or like supporting frame. Key guide body 76 is inserted into a recess which is partially formed beneath the trigger guard of gun 54, and partially formed along the left side of the gun handle thereof, as viewed in FIG. 11. Key guide body 76 is held in place by means of pins 72 and 78.

Referring to FIG. 12, there is shown an exploded view depicting key guide body 76, safety levers 68 and 70, and spring 74.

Figure 13:
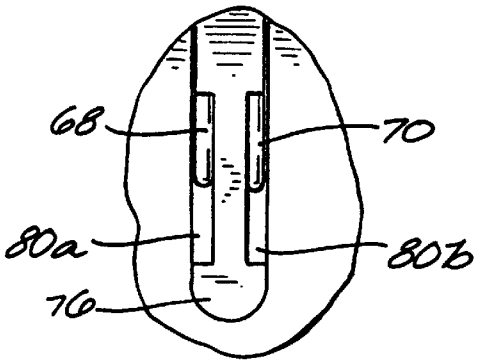
FIG. 13 is a view taken along lines 13—13 of FIG. 11.

Referring to FIG. 13, there are shown slots or rectangular apertures 80*a* and 80*b* formed through key guide body 76, to provide access to the lower members of levers 68 and 70, respectively.

Figure 14:
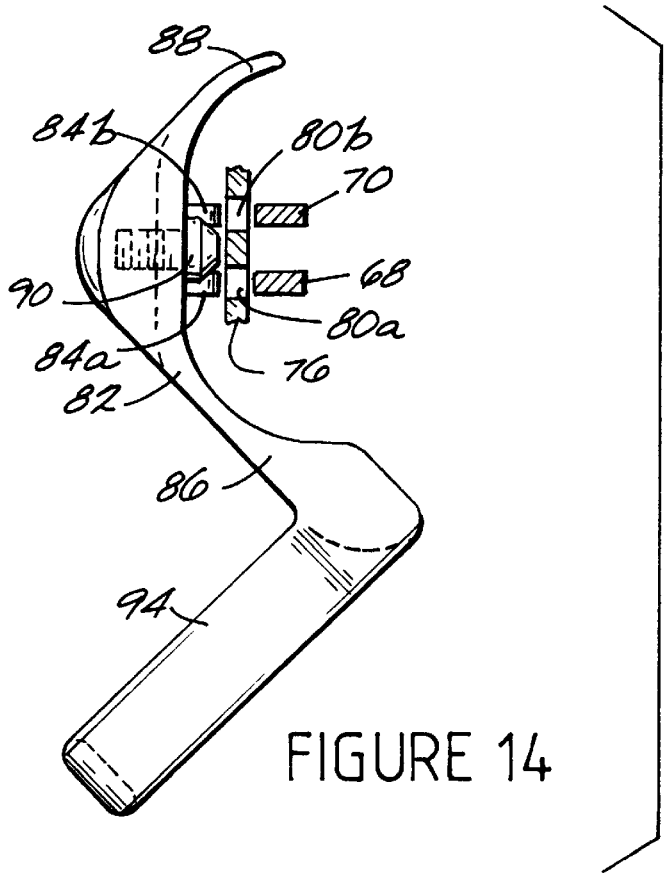
FIG. 14 is a sectional view taken along lines 14—14 of FIG. 10.
Figure 15:
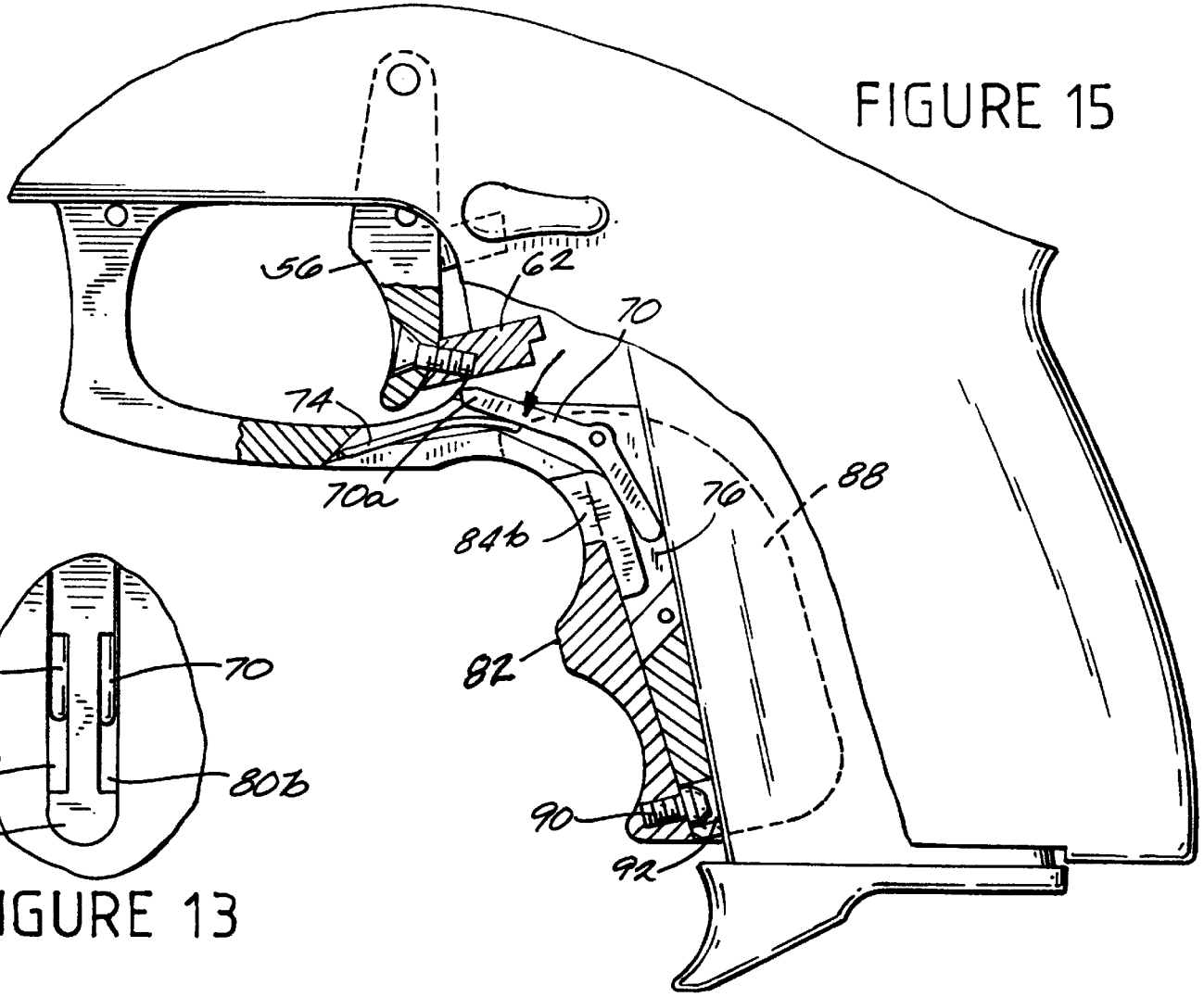
FIG. 15 is a partial sectional view showing the embodiment of FIG. 10 in a released mode.

Referring to FIGS. 11 and 14 together, there is shown a grip key 82 detached from gun 54 and provided with two key elements 84*a* and 84*b*. Grip key 82 is adapted to be placed upon or seated against key guide body 76 and the handle of gun 54, in close abutting relationship and at a precisely defined position with respect thereto. This is show in FIGS. 10 and 15. When grip key 82 is seated upon the guide body 76, key element 84*b* is inserted through slot 80*b* to bear against the lower member of safety lever 70, as likewise shown in FIGS. 10 and 15. Lever 70 is thereby pivoted in a counterclockwise direction, as shown by the arrow in FIG. 15, so that end 70*a* of lever 70 is moved out of the path of travel of the lug 62. Similarly, key element 84*a* is brought to bear against lever 68, to pivot end 68*a* thereof out of the path of travel of the lug. Trigger 56 may then be pulled or pivoted rightward, as shown in FIG. 15, to fire gun 54.

FIGS. 11 and 14 show that grip key 82 is provided with guides 86 and 88. The guides are disposed to extend along opposing sides of the gun handle and serve to assist in seating grip key 82 upon key guide body 76 in the precise relationship required to insert the key elements into the slots 80*a* and 80*b*. FIGS. 11 and 14 further show grip key 82 provided with an alignment screw 90, and the grip key body 76 provided with a complementary hole or recess 92. Screw 90 is inserted into recess 92 to further assist in precisely positioning the grip key on guide body 76.

In like manner with the embodiment described above in connection with gun 10, key elements 84*a* and 84*b* are usefully designed to uniquely mate with key guide body 76 of gun 54. For example, key elements 84*a* and 84*b* may have widths 0.062 inches and 0.050 inches, respectively. The slots 80*a* and 80*b*, through which the key elements must pass to reach their corresponding safety levers, are likewise sized to such widths, respectively. Also, the spacing between the slots is selected to exactly match the spacing between the key elements 84*a* and 84*b*. Thus, someone in possession of the uniquely designed grip key 82 will be able to quickly and conveniently displace the safety levers 68 and 70 in order to fire the gun 54. However, without grip key 82 it will be difficult, at best, to fire the gun.

Figure 16:
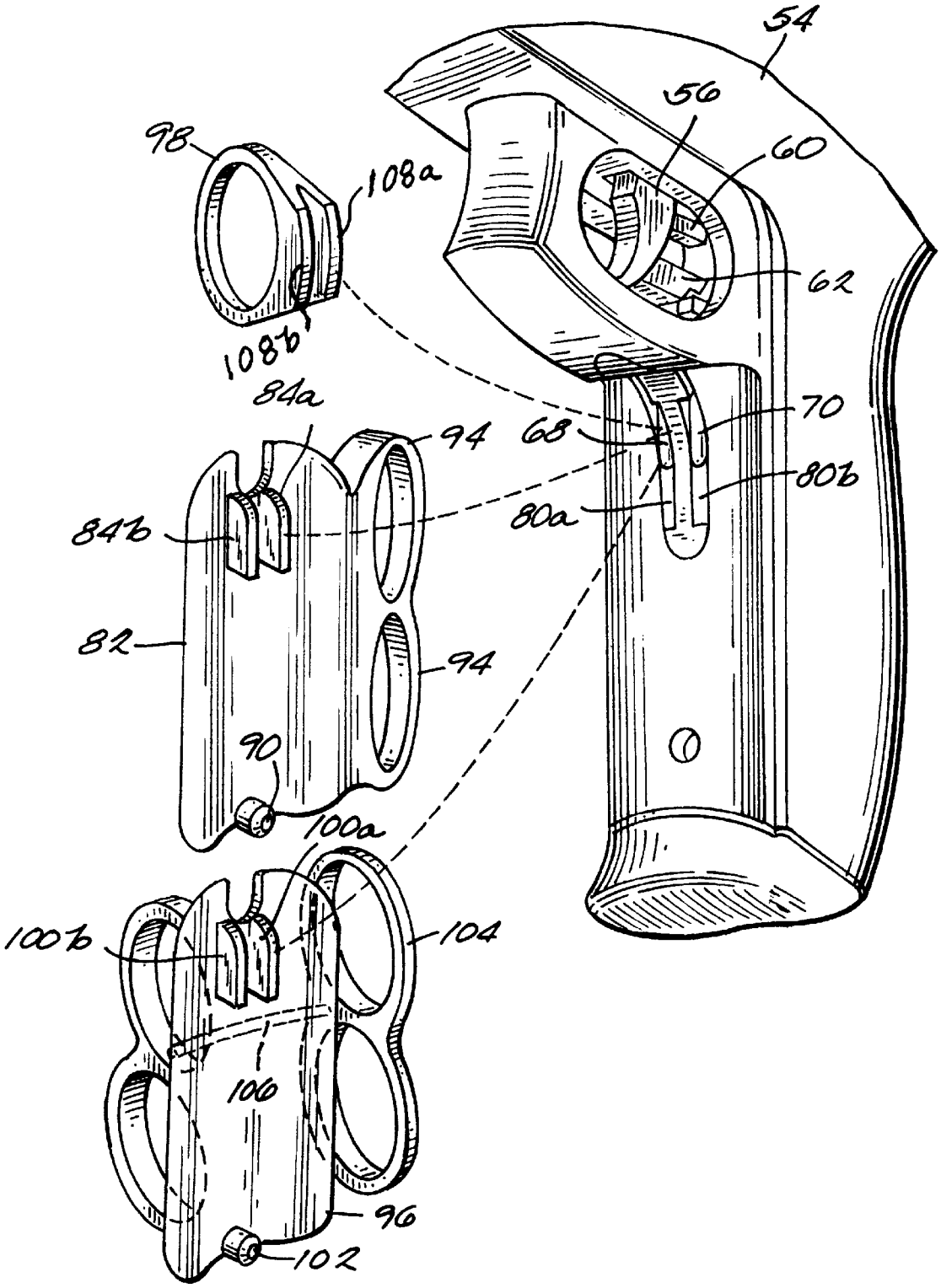
FIG. 16 is a perspective view showing alternative grip keys for the embodiment of FIG. 10.

Referring to FIG. 16, there is shown grip key 82 provided with finger rings 94, similar to the finger rings 44 of grip key 32, described above.

FIG. 16 shows two alternative grip key embodiments 96 and 98. Grip key 96 comprises key elements 100*a* and 100*b* disposed for insertion into slots 80*a* and 80*b*, respectively, and an alignment screw 102. Finger rings 104 are joined to grip key 96 by means of a thin cable element 106 or the like. Grip key 98 is intended to be worn on a user's finger, and is provided with key elements 108*a* and 108*b* disposed for insertions into slots 80*a* and 80*b*, respectively.

While the embodiments described above are intended for use with automatic pistols, the invention could be readily modified for use with other types of firearms, including revolvers, rifles and shotguns. It is anticipated that those of skill in the art will be able to readily adapt the invention to all such classes of firearms. Moreover, the term "handle", as used in connection with the invention, is intended to include any structure attached to a gun which is intended to be grasped by a user's hand, to enable the user to support or manipulate the gun.

Obviously, many other modifications and variations of the present invention are possible in light of the above teachings. It is therefore to be understood that within the scope of the disclosed concept, the invention may be practiced otherwise than as has been specifically described.

What is claimed is:

1. An apparatus for use with a firearm provided with a handle and with a trigger disposed for specified movement to discharge the firearm, said apparatus comprising:

a locking mechanism mounted on said firearm and selectively moveable between trigger locking and trigger release positions, said locking mechanism acting to prevent movement of said trigger when said locking mechanism is in said locking position, and said locking mechanism enabling movement of said trigger when said locking mechanism is in said release position;

means for biasing said locking mechanism into said trigger locking position;

a key support member adapted for engagement by the hand of a user of said firearm to enable said user to seat said key support member against said firearm handle, in a specified position relative thereto, and to detach said key support member from said firearm, selectively; and a specified number of key elements mounted on said key support member, each of said key elements being operable to positively contact said trigger locking mechanism and to positively move said locking mechanism from said trigger locking position to said trigger release position when said key support member is seated against said handle in said specified position.

2. An apparatus for use with a firearm provided with a handle and with a trigger disposed for specified movement to discharge the firearm, said apparatus comprising:

a locking mechanism mounted on said firearm and selectively moveable between trigger locking and trigger release positions, said locking mechanism acting to prevent movement of said trigger when said locking mechanism is in said locking position, and said locking mechanism enabling movement of said trigger when said locking mechanism is in said release position;

means for biasing said locking mechanism into said trigger locking position;

a key support member adapted for engagement by the hand of a user of said firearm to enable said user to seat said key support member against said firearm handle, in a specified position relative thereto, and to detach said key support member from said firearm, selectively;

a specified number of key elements mounted on said key support member, each of said key elements being operable to urge said locking mechanism to said trigger release position when said key support member is seated against said handle in said specified position; and a key guide body provided with an aperture corresponding to each of said key elements, each of said apertures having dimensions which substantially match the dimensions of a cross-section of its corresponding key element, said key guide body being joined to said firearm to enable each of said key elements to pass through its corresponding aperture as said key support member is being seated into said specified position against said handle.

3. The apparatus of claim 2 wherein:

a plurality of said key elements are mounted on said key support member, and said key guide body is provided with a corresponding plurality of said apertures.

4. The apparatus of claim 3 wherein:

said key support member is provided with alignment means for guiding said key support member into said specified position relative to said handle.

5. The apparatus of claim 4 wherein said alignment means comprises:

a plurality of guide surfaces disposed to mate with respectively corresponding surfaces of said handle; and a selected number of locator pins, each of said pins disposed for insertion into a complimentary locator hole formed in said handle.

6. The apparatus of claim 5 wherein:

said key support member is provided with a selected number of rings, each of said rings disposed to receive a finger of said user's hand.

7. The apparatus of claim 4 wherein said trigger is translated along a trigger guard to discharge said firearm and wherein:

said key guide body comprises a specified portion of said trigger guard, and each of said apertures comprises a hole drilled completely through said trigger guard, each of said drilled holes having an upper end and a lower end;

said locking mechanism comprises a plurality of locking pins, each of said locking pins being at least partially receivable into a corresponding well formed in a portion of said trigger which is proximate to said trigger guard;

said biasing means comprises a spring inserted into each of said wells, each of said springs acting to urge at least a portion of a corresponding locking pin into the upper end of one of said apertures, if said trigger is in said trigger locking position; and said key elements are insertable into their respective corresponding apertures, through the lower ends thereof, to urge each of said locking pins out of said apertures to release said trigger from said trigger locking position.

8. The apparatus of claim 4 wherein said trigger is pivotable moved about a specified point to discharge said firearm, and wherein:

said locking mechanism comprises a plurality of levers which are pivotable about a common axis between said trigger locking and said trigger release positions, each of said levers, when in its trigger locking position, acting to prevent said pivotable movement of said trigger;

said biasing means comprises a resilient member disposed to urge each of said levers to said trigger locking position; and each of said key elements engages one of said levers, and pivots the engaged lever to the trigger release position thereof when said support member is moved to said specified seating position relative to said handle.

9. The apparatus of claim 8 wherein:

a lug member is fixably joined to said trigger for movement therewith; and each of said levers, when pivoted into its respective trigger locking position, is brought into the path of travel of said lug member to prevent movement of said lug member and said trigger.

10. The apparatus of claim 4 wherein:

said apparatus is selected from a plurality of similar firearm apparatuses, each having an associated key guide body and set of key elements, the key guide body and key elements associated with said selected apparatus being operable only with each other.

11. An apparatus for use with a firearm provided with a trigger disposed for movement, said apparatus comprising:

locking means mounted on said firearm and moveable between trigger locking and trigger release positions for respectively preventing and enabling movement of said trigger;

a key support member disposed for placement against said firearm in specified abutting relationship, and for detachment from said firearm, selectively; and key element means mounted on said key support member for positively contacting and moving said locking means from its trigger locking position to its trigger release position when said key support member is placed against said firearm in said specified abutting relationship.

12. An apparatus for use with a firearm provided with a trigger disposed for movement, said apparatus comprising:

locking means mounted on said firearm and moveable between trigger locking and trigger release positions for respectively preventing and enabling movement of said trigger, wherein said locking means comprises a plurality of locking elements, each supported for movement between a trigger locking position and a trigger release position, and a key guide body provided with a plurality of apertures, each corresponding to one of said locking elements;

a key support member disposed for placement against said firearm in specified abutting relationship, and for detachment from said firearm, selectively; and key element means mounted on said key support member for urging said locking means to its trigger release position when said key support member is placed against said firearm in said specified abutting relationship, wherein said key element means comprises a plurality of key elements, each of said key elements disposed for insertion through one of said apertures to urge the locking element corresponding thereto to its trigger release position, when said key support member is placed against said firearm in said specified abutting relationship.

13. The apparatus of claim 12 wherein:

said locking means further comprises means for biasing each of said locking elements to its trigger locking position.

14. The apparatus of claim 13 wherein:

said key support member is provided with engagement means for enabling a user of said firearm to maneuver said key support member with a single hand, to readily place said key support member against said firearm in said specified abutting relationship, and to detach said key support member from said firearm, selectively.

15. The apparatus of claim 14 wherein:

said key support member is provided with alignment means for guiding said key support member into said specified abutting relationship with said firearm.

16. The apparatus of claim 15 wherein:

said engagement means comprises a selected number of rings joined to said key support member, each of said rings disposed to receive a finger of said user's hand.

17. The apparatus of claim 13 wherein said trigger is translated along a trigger guard to discharge said firearm and wherein:

said key guide body comprises a specified portion of said trigger guard, and each of said apertures comprises a hole drilled completely through said trigger guard, each of said drilled holes having an upper end and a lower end;

each of said locking elements comprises a locking pin, each of said locking pins being at least partially receivable into a corresponding well formed in a portion of said trigger which is proximate to said trigger guard;

said biasing means comprises a spring inserted into each of said wells, each of said springs acting to urge at least a portion of a corresponding locking pin into the upper end of one of said apertures; and said key elements are insertable into respective corresponding apertures, through the lower ends thereof, to urge each of said locking pins out of said apertures to release said trigger for movement.

18. The apparatus of claim 13 wherein said trigger is pivotable moved about a specified point to discharge said firearm, and wherein:

each of said locking elements comprises a lever which is pivotable about an axis between its trigger locking and trigger release positions, each of said levers, when in its trigger locking position, acting to prevent said pivotable movement of said trigger;

said biasing means comprises a resilient member disposed to urge each of said levers to its trigger locking position; and each of said key elements engages one of said levers, and pivots the engaged lever to its trigger release position thereof said key support member is moved into said specified abutting relationship with said firearm.

* * * * *